US008042283B2

(12) United States Patent
Nakiri

(10) Patent No.: US 8,042,283 B2
(45) Date of Patent: Oct. 25, 2011

(54) WASHER-DRYER

(75) Inventor: Kazutoshi Nakiri, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 1026 days.

(21) Appl. No.: 11/913,424

(22) PCT Filed: Jun. 23, 2006

(86) PCT No.: PCT/JP2006/312630

§ 371 (c)(1),
(2), (4) Date: Nov. 2, 2007

(87) PCT Pub. No.: WO2007/000951

PCT Pub. Date: Jan. 4, 2007

(65) Prior Publication Data

US 2009/0064533 A1 Mar. 12, 2009

(30) Foreign Application Priority Data

Jun. 28, 2005 (JP) ..... 2005-188149

(51) Int. Cl.
*F26B 11/02* (2006.01)

(52) U.S. Cl. ..... 34/595; 34/90; 34/610; 68/18 R; 68/16; 8/142; 8/134; 134/72; 432/68; 432/98; 366/7; 366/229; 165/86

(58) Field of Classification Search ..... 34/595, 34/90, 610, 80, 86, 134, 117, 124; 68/5 C, 68/18 R, 16; 165/86; 8/134, 142; 366/7, 366/229; 134/72; 432/68, 98
See application file for complete search history.

(56) References Cited

U.S. PATENT DOCUMENTS

| | | | | | |
|---|---|---|---|---|---|
| 1,844,782 | A | * | 2/1932 | Mittag | 62/314 |
| 2,053,159 | A | * | 9/1936 | Miller | 96/125 |
| 2,080,946 | A | * | 5/1937 | Lesher | 201/5 |
| 2,114,776 | A | * | 4/1938 | Davis | 68/18 R |
| 2,137,158 | A | * | 11/1938 | Douglass | 432/80 |
| 2,163,513 | A | * | 6/1939 | Douglass | 106/750 |
| 2,185,878 | A | * | 1/1940 | Adams et al. | 34/527 |
| 2,188,506 | A | * | 1/1940 | Hall | 426/471 |
| 2,240,503 | A | * | 5/1941 | Kettenbach | 209/3 |
| 2,250,238 | A | * | 7/1941 | Smith | 134/72 |

(Continued)

FOREIGN PATENT DOCUMENTS

JP 61276634 A * 12/1986

(Continued)

OTHER PUBLICATIONS

International Search Report for corresponding Application No. PCT/JP2006/312630 dated Aug. 1, 2006.

*Primary Examiner* — Stephen M. Gravini
(74) *Attorney, Agent, or Firm* — Renner, Otto, Boisselle & Sklar, LLP

(57) ABSTRACT

A blower 31 has a blower fan 35, a fan motor 36 for driving the blower fan 35 into rotation, and a shaft 52 having one end portion coupled to the blower fan 35 and the other end portion coupled to the fan motor 36. Washing liquid fed into the water tank during washing process or rinsing process is intruded inside the fan case 34, and the one end portion of the shaft 52 is immersed in the washing liquid.

9 Claims, 8 Drawing Sheets

U.S. PATENT DOCUMENTS 2,275,116 A * 3/1942 Vogel-Jorgensen ..... 34/386
2,287,795 A * 6/1942 Hall ..... 159/4.2
2,308,883 A * 1/1943 Kettenbach ..... 47/58.1 R
2,310,680 A * 2/1943 Dinley ..... 34/74
2,316,669 A * 4/1943 Busi ..... 68/20
2,340,345 A * 2/1944 Richeson ..... 34/575
2,369,366 A * 2/1945 O'Neill ..... 34/267
2,400,726 A * 5/1946 Wright et al. ..... 118/52
2,441,992 A * 5/1948 Converse ..... 68/5 E
2,452,858 A * 11/1948 Miller ..... 264/605
2,467,470 A * 4/1949 Mekler et al. ..... 425/8
2,480,346 A * 8/1949 Watts ..... 62/155
2,523,058 A * 9/1950 Ransohoff ..... 134/46
2,539,407 A * 1/1951 Dinley ..... 34/74
2,573,966 A * 11/1951 Hamlin ..... 8/142
2,624,955 A * 1/1953 Robison ..... 34/92
2,695,221 A * 11/1954 Weston ..... 75/750
2,695,459 A * 11/1954 Hutchins ..... 34/418
2,758,461 A * 8/1956 Tann ..... 68/19.1
2,797,567 A * 7/1957 Heien ..... 68/16
2,798,306 A * 7/1957 Reiter ..... 34/609
2,822,153 A * 2/1958 Arnold ..... 366/229
2,834,122 A * 5/1958 Ashworth ..... 34/665
2,853,798 A * 9/1958 Morrison ..... 34/75
2,903,400 A * 9/1959 Poindexter et al. ..... 202/109
2,911,810 A * 11/1959 Lantz et al. ..... 68/12.15
2,925,663 A * 2/1960 Smith ..... 34/75
2,954,613 A * 10/1960 Baker ..... 34/102
3,023,514 A * 3/1962 Gibson ..... 34/589
3,027,652 A * 4/1962 Wallace ..... 34/424
3,102,794 A * 9/1963 Arnold ..... 34/371
3,110,544 A * 11/1963 Moulthrop ..... 8/137
3,155,462 A * 11/1964 Erickson et al. ..... 34/82
3,161,481 A * 12/1964 Edwards ..... 34/527
3,169,157 A * 2/1965 Harris ..... 432/64
3,186,102 A * 6/1965 Brociner et al. ..... 34/364
3,186,104 A * 6/1965 Stilwell, Jr. ..... 34/527
3,213,858 A * 10/1965 Merritt et al. ..... 131/372
3,229,383 A * 1/1966 Kamp ..... 34/65
3,254,881 A * 6/1966 Rusk ..... 432/51
3,273,256 A * 9/1966 Behrens ..... 34/546
3,292,347 A * 12/1966 Hodgkinson ..... 261/83
3,306,596 A * 2/1967 Hollowell ..... 432/68
3,316,652 A * 5/1967 Van Gelder ..... 34/292
3,328,894 A * 7/1967 Smith, Jr. ..... 34/583
3,331,595 A * 7/1967 Nelson et al. ..... 432/98
3,345,180 A * 10/1967 Smith, Jr. ..... 426/314
3,386,719 A * 6/1968 Martin ..... 266/130
3,389,707 A * 6/1968 Wochnowski ..... 131/303
3,395,634 A * 8/1968 Smith, Jr. ..... 99/483
3,525,161 A * 8/1970 Jesperson ..... 34/322
3,585,734 A * 6/1971 Barton et al. ..... 34/116
3,603,001 A * 9/1971 Arnold et al. ..... 34/136
3,612,069 A * 10/1971 Waters et al. ..... 132/212
3,650,040 A * 3/1972 Statham et al. ..... 34/80
3,727,321 A * 4/1973 Waters et al. ..... 34/99
3,850,224 A * 11/1974 Vidmar et al. ..... 164/456
3,947,239 A * 3/1976 Nelson ..... 432/14
4,112,590 A * 9/1978 Muller ..... 34/75
4,195,419 A * 4/1980 Quayle ..... 34/231
4,256,944 A * 3/1981 Brandon ..... 219/686
4,330,946 A * 5/1982 Courneya ..... 34/263
4,338,730 A * 7/1982 Tatsumi et al. ..... 34/569
4,449,764 A * 5/1984 Hastings ..... 312/236
4,489,506 A * 12/1984 Brown et al. ..... 34/577
4,497,121 A * 2/1985 Choinski ..... 34/445
4,589,712 A * 5/1986 Hastings ..... 312/236
4,640,344 A * 2/1987 Pravda ..... 165/86
4,765,066 A * 8/1988 Yoon ..... 34/261
4,932,785 A * 6/1990 Bracegirdle ..... 366/7
4,941,820 A * 7/1990 Lockwood, Jr. ..... 432/58
4,958,443 A * 9/1990 Haueter et al. ..... 34/593
4,984,587 A * 1/1991 Neville ..... 131/305
4,992,043 A * 2/1991 Lockwood, Jr. ..... 432/58
5,092,960 A * 3/1992 Brown ..... 159/48.1
5,107,606 A * 4/1992 Tsubaki et al. ..... 34/596
5,208,940 A * 5/1993 London et al. ..... 15/345
5,212,969 A * 5/1993 Tsubaki et al. ..... 68/19.2
5,263,267 A * 11/1993 Buttner et al. ..... 34/519
5,292,226 A * 3/1994 Ward ..... 415/170.1
5,477,623 A * 12/1995 Tomizawa et al. ..... 34/58
5,565,112 A * 10/1996 Bratten ..... 210/780
5,697,168 A * 12/1997 Matthys et al. ..... 34/137
5,709,234 A * 1/1998 Lashmett et al. ..... 134/92
5,992,041 A * 11/1999 McClaine et al. ..... 34/178
6,607,768 B1 * 8/2003 Eichner ..... 426/466
6,651,357 B2 * 11/2003 Bria et al. ..... 34/427
6,694,639 B2 * 2/2004 Hanaya ..... 34/115
6,920,704 B1 * 7/2005 Silverbrook et al. ..... 34/422
6,944,970 B2 * 9/2005 Silverbrook et al. ..... 34/621
6,968,632 B2 * 11/2005 Guinibert et al. ..... 34/602
7,055,262 B2 * 6/2006 Goldberg et al. ..... 34/86
7,065,905 B2 * 6/2006 Guinibert et al. ..... 34/603
7,117,613 B2 * 10/2006 Guinibert et al. ..... 34/534
7,225,562 B2 * 6/2007 Guinibert et al. ..... 34/601
7,257,905 B2 * 8/2007 Guinibert et al. ..... 34/82
7,331,119 B2 * 2/2008 Perry et al. ..... 34/168
7,412,783 B2 * 8/2008 Guinibert et al. ..... 34/572
7,467,483 B2 * 12/2008 Guinibert et al. ..... 34/601
7,665,225 B2 * 2/2010 Goldberg et al. ..... 34/73
7,665,226 B2 * 2/2010 Tsuruta et al. ..... 34/259
7,762,007 B2 * 7/2010 Guinibert et al. ..... 34/601
2002/0092198 A1 * 7/2002 Bria et al. ..... 34/444
2003/0019125 A1 * 1/2003 Hanaya ..... 34/114
2003/0145482 A1 * 8/2003 Perry et al. ..... 34/218
2005/0066538 A1 * 3/2005 Goldberg et al. ..... 34/218
2005/0076535 A1 * 4/2005 Guinibert et al. ..... 34/601
2005/0115104 A1 * 6/2005 Guinibert et al. ..... 34/601
2005/0155248 A1 * 7/2005 Silverbrook et al. ..... 34/422
2005/0155252 A1 * 7/2005 Silverbrook et al. ..... 34/621
2005/0262720 A1 * 12/2005 Rane et al. ..... 34/330
2006/0042113 A1 * 3/2006 Ekart et al. ..... 34/58
2006/0053650 A1 * 3/2006 Manak et al. ..... 34/60
2006/0080974 A1 * 4/2006 Ono et al. ..... 62/93
2006/0112588 A1 * 6/2006 Ness et al. ..... 34/513
2006/0179676 A1 * 8/2006 Goldberg et al. ..... 34/77
2007/0006477 A1 * 1/2007 Guinibert et al. ..... 34/85
2007/0033828 A1 * 2/2007 Hartkop et al. ..... 34/443
2007/0186440 A1 * 8/2007 Guinibert et al. ..... 34/603
2007/0220776 A1 * 9/2007 Guinibert et al. ..... 34/603
2007/0271811 A1 * 11/2007 Tsuruta et al. ..... 34/263
2008/0120867 A1 * 5/2008 Perry et al. ..... 34/505
2008/0201980 A1 * 8/2008 Bullinger et al. ..... 34/493
2009/0064533 A1 * 3/2009 Nakiri ..... 34/596

FOREIGN PATENT DOCUMENTS

JP 03-026292 2/1991
JP 03239793 A * 10/1991
JP 06147167 A * 5/1994
JP 09014839 A * 1/1997
JP 10-127975 5/1998
JP 2001-113079 4/2001
JP 2005-124761 5/2005
JP 2006136448 A * 6/2006
JP 2010012088 A * 1/2010
JP 2010012089 A * 1/2010
JP 2010012090 A * 1/2010

* cited by examiner

WASHER-DRYER

TECHNICAL FIELD

The present invention relates to a washer-dryer.

BACKGROUND ART

As a conventionally available washer-dryer, a drum type washer-dryer is disclosed in JP 2001-113079 A. This drum type washer-dryer includes an outer casing, a water tank placed within the outer casing, a drum rotatably placed within the water tank, and a drying system for drying washing loads contained in the drum.

The drying system has a dehumidifier, a fan unit for sucking in air dehumidified by the dehumidifier, a heating unit for heating air blown out by the fan unit, and a duct for guiding air heated by the this heating unit into the drum.

The fan unit has a fan case, a blower fan rotatably placed within the fan case, a fan motor for driving the blower fan into rotation, and a shaft one end of which is connected to the blower fan and the other end of which is connected to the fan motor. This shaft rotates integrally with the blower fan.

In the drum type washer-dryer of this construction, as the fan unit operates, air in the water tank flows through the dehumidifier, the fan unit and the heating unit in sequence during a drying process. By this process, the air is dehumidified by the dehumidifier with the humidity lowered, and then heated by the heating unit with the temperature increased. This high-temperature, low-humidity air is guided by the duct so as to be blown out into the drum, absorbing the moisture of the washing loads within the drum to increase in its humidity, and thereafter flows again through the dehumidifier, the fan unit and the heating unit in sequence. The washing loads are dried by such a circulation of air.

In this case, waste threads of the washing loads are scattered within the water tank during the drying process. These waste threads pass through the dehumidifier along with air, being deposited on the fan unit. More specifically, the waste threads get entangled with a blower-fan side end portion of the shaft. Then, as the number of times the drying process has been executed increases, the waste threads are deposited inside the fan unit or on the blower-fan side end portion of the shaft. The deposited waste threads cause a narrowing of the air circulation path as well as a resistance to the shaft, thus inhibiting the rotation of the shaft.

As a result, the flow of air in the circulation path is worsened and the rotation of the blower fan becomes insufficient, so that the air for drying the washing loads no longer efficiently circulates. This would lead to a problem of deteriorated drying efficiency of washing loads.

The deterioration of the drying efficiency of washing loads would be a considerable problem when the drum type washer-dryer is used for a long time.

SUMMARY OF THE INVENTION

Accordingly, an object of the present invention is to provide a washer-dryer capable of preventing the drying efficiency of washing loads from deteriorating even over long-time use.

In order to achieve the above object, according to the present invention, there is provided a washer-dryer comprising:

an outer casing;

a water tank placed within the outer casing;

a rotary tank which is rotatably placed within the water tank and which contains therein washing loads;

a fan unit for blowing air into the water tank during drying process; and a heating unit which is provided downstream of the fan unit and which heats air directed toward interior of the water tank, wherein the fan unit has:

a blower fan;

a fan motor for driving the blower fan into rotation; and a shaft having one end portion coupled to the blower fan and the other end portion coupled to the fan motor, and wherein the one end portion of the shaft is immersed in washing liquid fed into the water tank during washing process or rinsing process.

In the washer-dryer of this construction, the washing liquid fed into the water tank during washing process or rinsing process enters into the fan unit with one end portion of the shaft immersed. Therefore, waste threads or other wastes deposited inside the fan unit as well as on one end portion of the shaft are dropped, so that deposition of waste threads or other wastes at one end portion of the shaft can be prevented. Therefore, the rotational speed of the blower fan is not lowered, so that the air for drying the washing loads can be continued to be efficiently circulated. As a result, deterioration of the drying efficiency for washing loads can be prevented. That is, deterioration of the drying efficiency for washing loads can be prevented even over long-time use.

One embodiment further comprises a dehumidification unit which is provided upstream of the heating unit and which dehumidifies the air directed toward the interior of the water tank, wherein the fan unit sucks the air in the water tank during drying process and blows the sucked air into the water tank.

In the washer-dryer of this embodiment, since the dehumidification unit is provided upstream of the heating unit, the air dehumidified by the dehumidification unit can be heated by the heating unit. Therefore, the temperature of the air directed toward the interior of the water tank can be easily increased by the heating unit. That is, even with the power of the heating unit lowered, enough warm air to dry the washing loads can be supplied into the water tank.

In one embodiment, the blower fan is driven into rotation during washing process or rinsing process.

In the washer-dryer of this embodiment, since the blower fan rotates during washing process or rinsing process, waste threads or other wastes deposited inside the fan unit or at one end portion of the shaft can be dropped aggressively.

Also, since the blower fan rotates during washing process or rinsing process, there occur water currents in the washing liquid contained in the water tank. As a result, by the water currents caused by the blower fan, waste threads or other wastes deposited on the heating unit and the dehumidification unit can be dropped aggressively.

In one embodiment, the heating unit is immersed in washing liquid fed into the water tank during washing process or rinsing process.

In the washer-dryer of this embodiment, since the heating unit is immersed in the washing liquid fed into the water tank during washing process or rinsing process, waste threads or other wastes can be dropped from the heating unit by the washing liquid.

In one embodiment, the dehumidification unit is immersed in washing liquid fed into the water tank during washing process or rinsing process.

In the washer-dryer of this embodiment, since the dehumidification unit is immersed in the washing liquid fed into the water tank during washing process or rinsing process, waste threads or other wastes can be dropped from the dehumidification unit by the washing liquid.

One embodiment further comprises a circulation path for returning into the water tank the washing liquid, which has come out of the water tank from within the water tank, to thereby circulate the washing liquid;

a filtering device which is placed on the circulation path and which removes wastes from the washing liquid flowing in the circulation path; and a circulation pump for sucking the washing liquid present in the water tank out of the water tank and discharging the sucked washing liquid toward the interior of the water tank, wherein the circulation pump is operated during washing process or rinsing process.

In the washer-dryer of this embodiment, since the circulation pump operates during washing process or rinsing process, the washing liquid in the water tank flows through the circulation path to return to the interior of the water tank via the filtering device. In this process, waste threads or other wastes are removed from the washing liquid by the filtering device. That is, the washing liquid from which the waste threads or other wastes have been removed returns to the water tank. Therefore, deposition of the waste threads or other wastes on the blower unit can be prevented.

In one embodiment, the circulation path has a suction port provided downstream of the fan unit for sucking therethrough the washing liquid present in the water tank.

In the washer-dryer of this embodiment, since the suction port for sucking the washing liquid contained in the water tank into the circulation path is provided downstream of the fan unit, waste threads or other wastes that have been dropped from the blower unit enter into the circulation path through the suction port along with the washing liquid. Therefore, since waste threads or other wastes that have been dropped from the blower unit can be captured by the filtering device, the occurrence that waste threads or other wastes dropped from the blower unit are circulated and re-deposited on the blower unit can be prevented.

One embodiment further comprises a seal member provided in adjacency to the shaft to maintain the blower fan and the fan motor watertight therebetween.

In the washer-dryer of this embodiment, since the seal member is provided on the outer peripheral surface of the shaft between the blower fan and the fan motor, the washing liquid can be prevented from being deposited on the fan motor while passing around the shaft. Therefore, failures of the fan motor due to deposition of the washing liquid on the fan motor can be prevented.

In one embodiment, the shaft is cooled by cooling water or cooling air.

In the washer-dryer of this embodiment, since the shaft is cooled by cooling water or cooling air, thermal damage of the seal member can be reduced.

In one embodiment, the shaft is cooled by cooling water and the cooling water that has cooled the shaft is fed to the dehumidification unit.

In the washer-dryer of this embodiment, since the shaft is cooled by cooling water, thermal damage of the seal member can be reduced.

Also, since the cooling water that has cooled the shaft is fed to the dehumidification unit, the use quantity of cooling water can be lessened. That is, a water saving effect by secondary use of the cooling water can be obtained.

According to the washer-dryer of the present invention, washing liquid fed into the water tank during washing process or rinsing process enters into the fan unit, and one end portion of the shaft is immersed therein, so that waste threads or other wastes can be prevented from being deposited inside the fan unit or at one end portion of the shaft. Therefore, the path for air is not narrowed and the rotational speed of the blower fan is not lowered, so that deterioration of the drying efficiency for washing loads can be prevented even over long-time use.

BRIEF DESCRIPTION OF THE DRAWINGS

The present invention will become more fully understood from the detailed description given hereinbelow and the accompanying drawings which are given by way of illustration only, and thus are not intended to limit the present invention, and wherein.

DETAILED DESCRIPTION OF THE INVENTION

Hereinbelow, the present invention will be described in detail by embodiments thereof illustrated in the accompanying drawings.

First Embodiment

Figure 1:
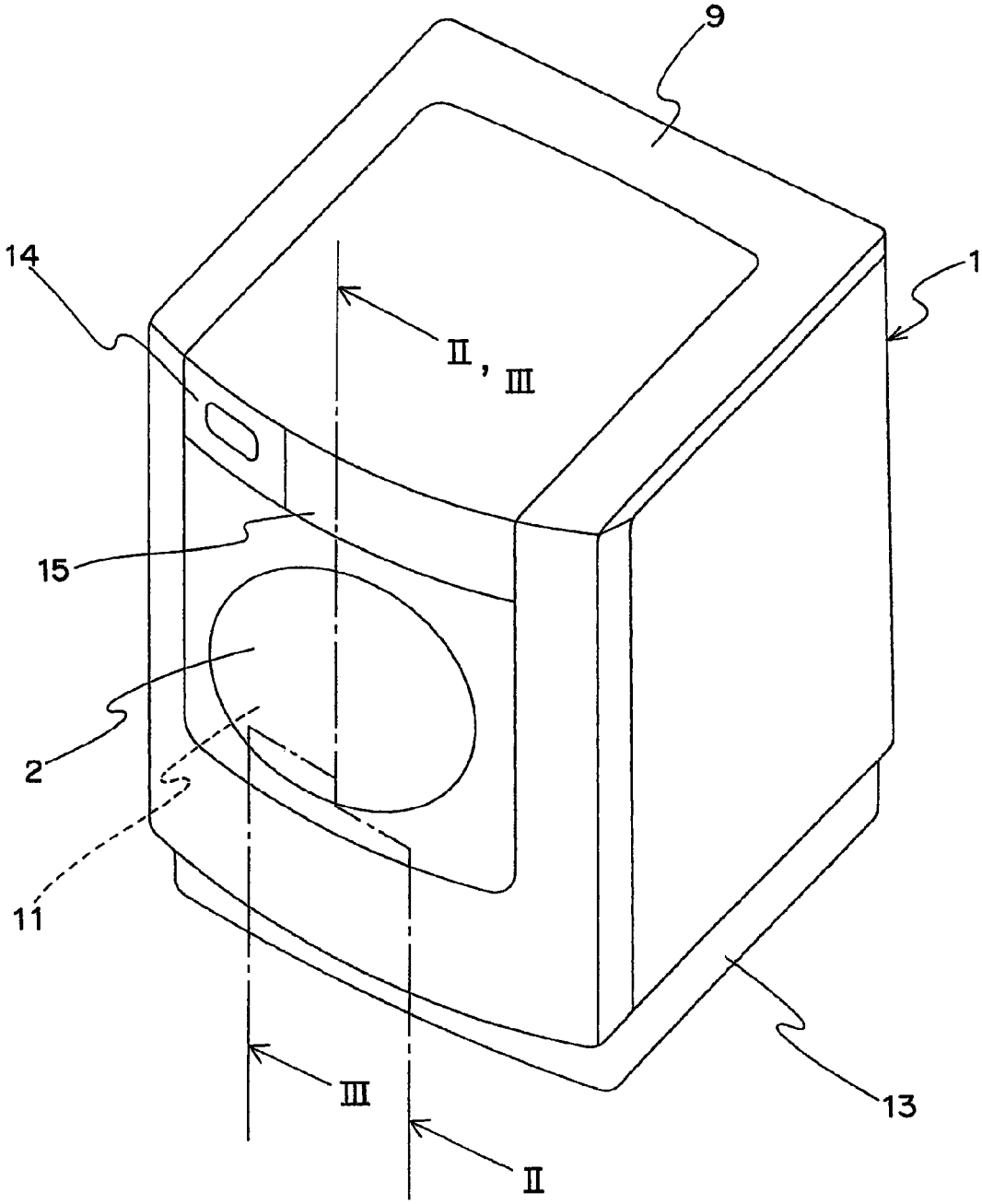
FIG. 1 is a schematic perspective view of a drum type washer-dryer according to a first embodiment of the present invention.

FIG. 1 shows a schematic view of a drum type washer-dryer according to a first embodiment of the present invention, as seen diagonally from above.

The drum type washer-dryer includes an outer casing 1 having an outer casing opening 11. An upper portion of the outer casing 1 is formed of a top plate 9, while a lower portion of the outer casing 1 is formed of a bottom base 13. The outer casing opening 11 is opened and closed by a door 2 pivotably fitted to the outer casing 1 with a hinge. At an upper portion of the outer casing 1 are provided a detergent case 14 for containing detergent, bleach and softener and an operation part 15 having operation keys and a display part.

Figure 2:
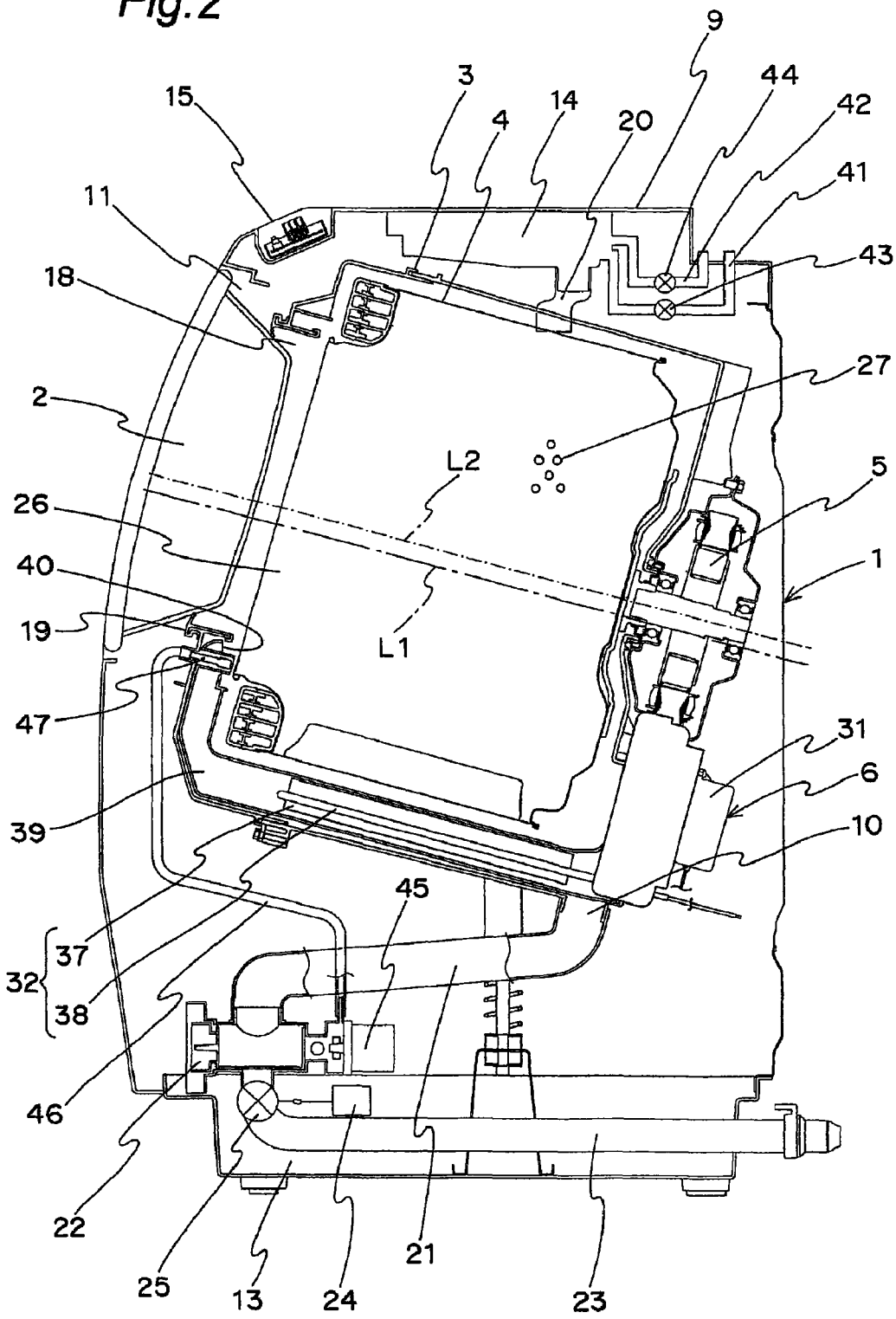
FIG. 2 is a sectional view taken along the line II-II of FIG. 1.

FIG. 2 shows a schematic sectional view as taken along the line II-II of FIG. 1.

The drum type washing machine includes a bottomed cylindrical-shaped water tank 3 placed within the outer casing 1, a bottomed cylindrical-shaped drum 4 which is rotatably placed within the water tank 3 and which contains therein washing loads, a motor 5 which is mounted at a rear portion of the water tank 3 and which drives the drum 4 into rotation, and a drying system 6 for drying washing loads. It is noted that the drum 4 is an example of a rotary tank.

In the water tank 3, a center axis L1 is inclined with respect to a horizontal plane so that a rear portion of the water tank 3 is set lower than its front portion. More specifically, the water tank 3 is inclined so that its center axis L1 is inclined to form an angle of 5°-30° with respect to the horizontal direction. The center axis L1 of the water tank 3 passes through a centroidal position P1 (see FIG. 4) in a cross section obtained by cutting the water tank 3 with a plane vertical to the rotational axis of the drum 4. Also, the center axis L1 of the water tank 3 is generally parallel to the rotational axis of the drum 4.

At a lower portion in the space within the water tank 3 is placed an air flow duct 39 through which warm air to be fed into the drum 4 flows. At a front-side end portion of the air flow duct 39, an air flow port 40 is formed so as to be positioned between a lower edge of a water tank opening 18 and a lower edge of a drum opening 26.

The water tank opening 18 is formed at a front face portion of the water tank 3 so as to be opposed to the outer casing opening 11. A packing 19 made from an elastic material such as rubber or soft resin is fixed at an opening edge of the water tank opening 18. Thus, when the door 2 is closed, the door 2 is brought into close contact with the packing 19, so that the liquid in the water tank 3 can be prevented from leaking out of the water tank 3.

A lower end portion of a feed water duct 20 for feeding washing liquid (water such as tap water and bath water, or water containing detergent or the like) into the water tank 3 is connected to an upper portion of the water tank 3. On the other hand, an upper end portion of the feed water duct 20 is connected to a lower portion of a detergent case 14. Also, a tap water feed passage 41 and a bath water feed passage 42 are connected to the detergent case 14. A water feed valve 43 is provided on the way of the tap water feed passage 41, while a bath water pump 44 is provided on the way of the bath water feed passage 42.

A drain port 10 for draining washing liquid in the water tank 3 is provided at a lower portion of the water tank 3. The drain port 10 is located on a downstream side of a blower 31. Also, an upper end portion of a drain duct 21 is connected to the drain port 10. On the other hand, a lower end portion of the drain duct 21 is connected to a drain hose 23 via a filtering device 22. It is noted that the drain duct 21 is an example of a circulation path. Also, the upper end portion of the drain duct 21 is an example of a suction port.

The liquid flowing through the drain duct 21 is allowed to flow into the drain hose 23 or a circulation hose 46 after passing through the filtering device 22. Since the filtering device 22 acts to remove foreign matters such as waste threads in the washing liquid that has flowed up in the drain duct 21, foreign matters can be prevented from intruding into the drain hose 23 or the circulation hose 46. It is noted that the circulation hose 46 is an example of the circulation path.

On the drain hose 23 is provided a drain valve 25 which is opened and closed by a drain motor 24. This drain valve 25 is so controlled as to be opened for allowing the washing liquid in the drain duct 21 to flow into the drain hose 23, and as to be closed for allowing the washing liquid in the drain duct 21 to flow into the circulation hose 46.

An upper end portion of the circulation hose 46 is connected to a circulation nozzle 47 provided at a lower portion of the front face of the water tank 3. On the other hand, a lower end portion of the circulation hose 46 is connected to a circulation pump 45 placed rearward of the filtering device 22.

The circulation pump 45 sucks the washing liquid in the drain duct 21 via the filtering device 22, and discharges the sucked washing liquid to the circulation hose 46. Activating this circulation pump 45 allows the washing liquid, which has come out of the water tank 3 through the drain port 10, to be passed through the filtering device 22 and thereafter returned into the water tank 3 again.

The drum 4 is located so that a center axis L2 coincident with a rotational axis of the drum 4 is decentered from the center axis L1 of the water tank 3 toward the top plate 9 of the outer casing 1. That is, the center axis L2 of the drum 4 is located more upward of the water tank 3 than the center axis L1 of the water tank 3. In other words, within a vertical plane containing the rotational axis of the drum 4, a distance between a lower portion of the drum 4 and a lower portion of the water tank 3 is larger than a distance between an upper portion of the drum 4 and an upper portion of the water tank 3. In short, the drum 4 is so placed as to be positioned on the upper side of the water tank 3. More specifically, the drum 4 has its rotational axis inclined to form an angle of 5° to 30° with respect to the horizontal direction, with its rear portion lower than its front portion. The center axis L2 of the drum 4 runs through a centroidal position P2 (see FIG. 4) in a cross section obtained by cutting the drum 4 with a plane vertical to the rotational axis of the drum 4.

Also, at a front face portion of the drum 4, the drum opening 26 is provided so as to be opposed to the outer casing opening 11 and the water tank opening 18. The drum opening 26 has a diameter larger than the water tank opening 18.

A plurality of small holes 27 are formed all over a peripheral wall of the drum 4. These small holes 27 are intended to allow the washing liquid, the dry air and the like to flow between two spaces, i.e., one space between the water tank 3 and the drum 4 and the other space within the drum 4. It is noted that in FIGS. 2 and 3, only six small holes 27 are shown and the other small holes 27 are omitted.

Figure 3:
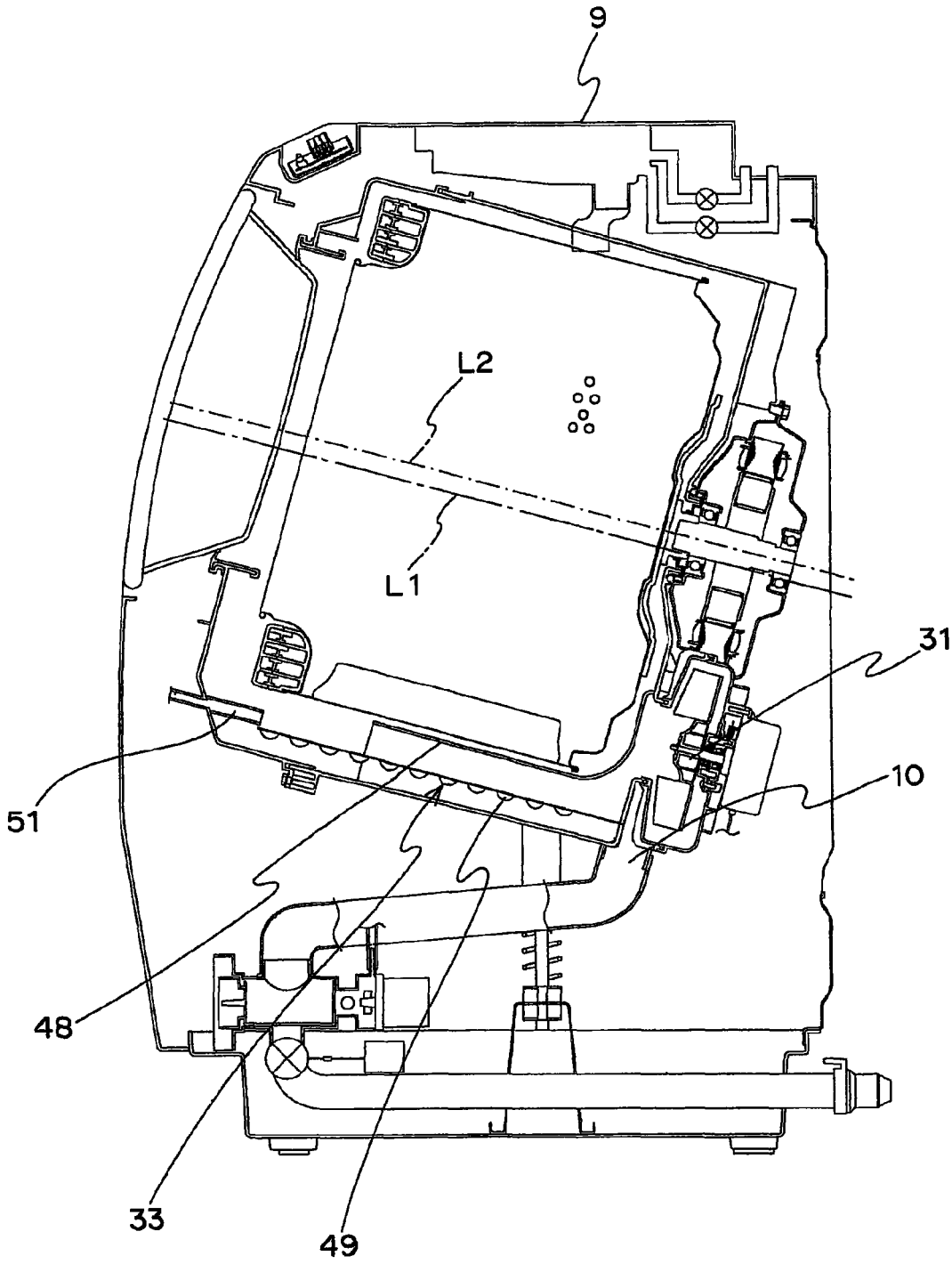
FIG. 3 is a sectional view taken along the line III-III of FIG. 1.
Figure 4:
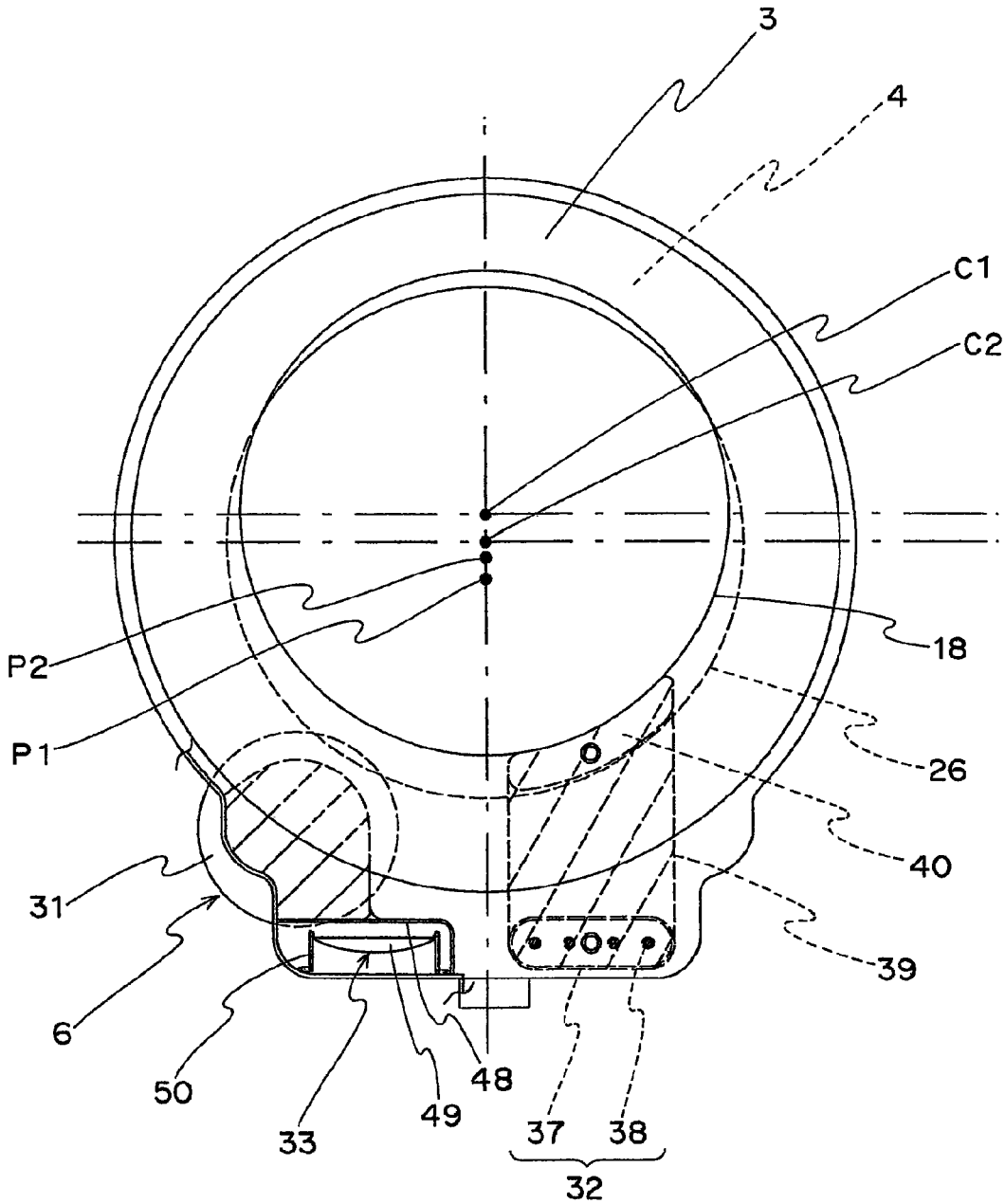
FIG. 4 is a schematic front view of a water tank of the drum type washer-dryer of the first embodiment.

The drying system 6 has the blower 31 as an example of the fan unit, a heating device 32 as an example of the heating unit, a dehumidification heat exchanger 33 (see FIGS. 3 and 4) as an example of a dehumidification unit, an air flow duct 39 and a plate cover 48 (see FIGS. 3 and 4). These blower 31, heating device 32, dehumidification heat exchanger 33, air flow duct 39 and plate cover 48 are respectively provided lower than a plane containing the center axis L1 of the water tank 3 and a horizontal axis orthogonal to the center axis L1.

The heating device 32 is placed at a lower portion in the space within the water tank 3. More specifically, the heating device 32 is placed between an inner peripheral surface of the water tank 3 and an outer peripheral surface of the drum 4 so as to be positioned in such a region that the heating device 32 is immersed in the washing liquid within the water tank 3. Further, the heating device 32 is positioned downstream of the blower 31.

Also, the heating device 32 is composed of a heater case 37 and a sheath heater 38 which in most part is housed in the heater case 37.

The heater case 37 is composed of a metallic main body and a frame which is made from heat-resistant resin and which fixes the main body. A front-side end portion of the heater case 37 is connected to the air flow duct 39.

The sheath heater 38 is capable of heating the air in the water tank 3 and, because of its being placed in such a region that it is immersed in the washing liquid contained in the water tank 3, also capable of heating the washing liquid in the water tank 3.

FIG. 3 shows a schematic sectional view as taken along the line III-III of FIG. 1.

The dehumidification heat exchanger 33 is positioned on an upstream side of the blower 31 attached to a rear-face lower portion of the water tank 3. More specifically, the dehumidification heat exchanger 33 is placed in such a region that the dehumidification heat exchanger 33 is immersed in the washing liquid between the inner peripheral surface of the water tank 3 and the outer peripheral surface of the drum 4.

Also, the dehumidification heat exchanger 33 has a metallic plate 49 and a stainless stationary member 50 (see FIG. 4) attached to an edge portion of the plate 49.

A rear portion (an end portion on the blower 31 side) of the plate 49 is covered with the plate cover 48 attached to an inner wall of the water tank 3.

On one surface of the plate 49 on the top plate 9 side, cooling water fed from a cooling nozzle 51 flows toward the blower 31 during the drying process. As a result of this, air is cooled by the cooling water and the plate 49 so that moisture contained in the air is effectively condensed.

The plate cover 48 guides the air containing moisture evaporated from the washing loads so that the air flows along the dehumidification-use heat exchange plate 49 to the blower 31.

The cooling nozzle 51, although not shown, is connected to an end portion downstream of the water feed valve 43 with respect to the tap water feed passage 41.

FIG. 4 shows a schematic front view of the water tank 3.

A center C1 of the water tank opening 18 is located closer to the top face of the outer casing 1 than a center C2 of the drum opening 26. That is, the water tank opening 18 is decentered toward the top face of the outer casing 1 with respect to the drum opening 26.

Figure 5:
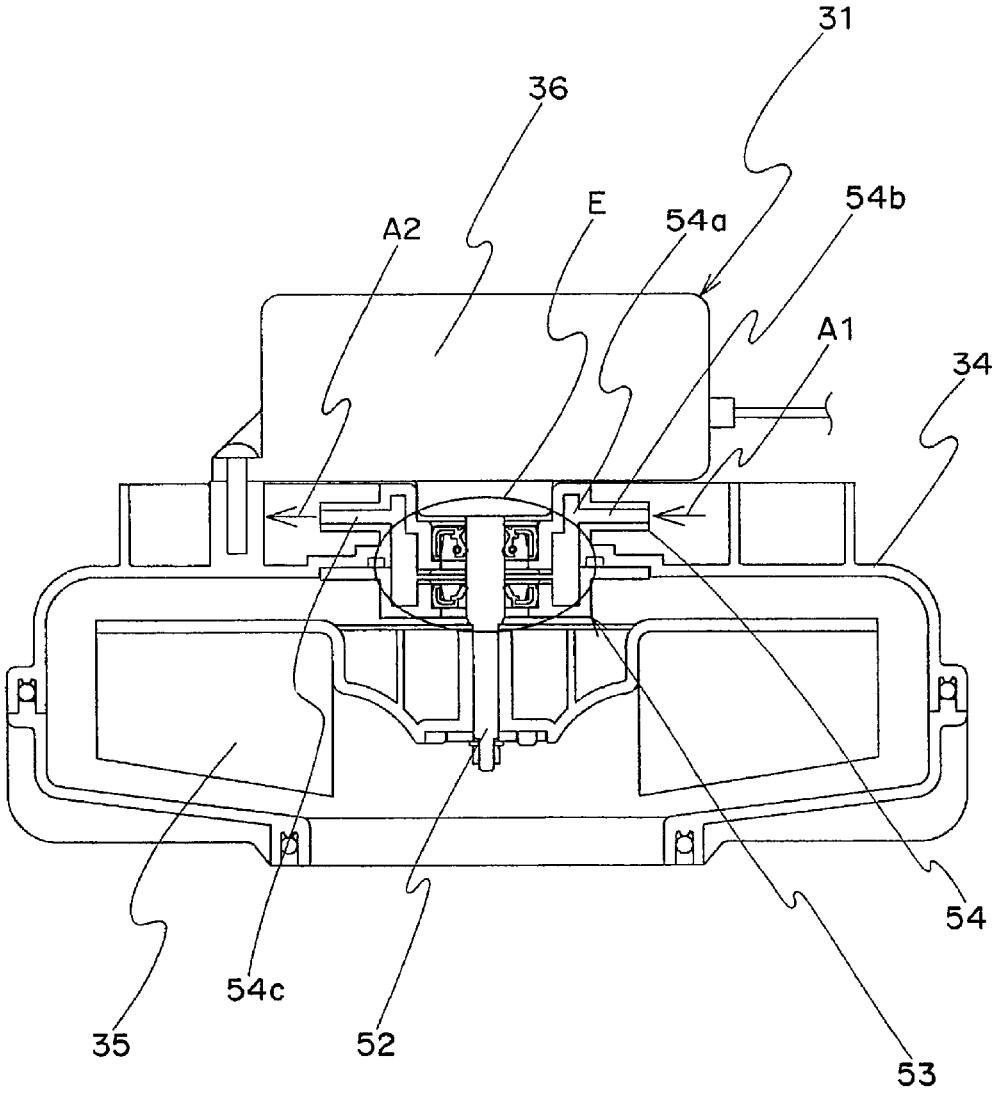
FIG. 5 is a schematic sectional view of a blower of the drum type washer-dryer of the first embodiment.

FIG. 5 shows a schematic sectional view of the blower 31.

The blower 31 has a fan case 34, a blower fan 35 rotatably placed within the fan case 34, a fan motor 36 for driving the blower fan 35 into rotation, a shaft 52 having one end portion coupled to the blower fan 35 and the other end portion coupled to the fan motor 36, and a seal holding portion 53 provided so as to surround the shaft 52 in the radial direction.

A space in the fan case 34 and a space in the water tank 3 communicate with each other. Accordingly, the washing liquid fed into the water tank 3 during washing process or rinsing process flows into the fan case 34.

The blower fan 35 is so placed as to be immersed in the washing liquid that flows into the fan case 34 during the washing process or rinsing process. Also, the blower fan 35 is controlled to be rotated during the washing process or rinsing process.

The shaft 52 is rotated along with the blower fan 35 under the action of rotational driving force of the fan motor 36. The shaft 52 is so placed that its end portion is immersed in the washing liquid that flows into the fan case 34 during the washing process or rinsing process.

The seal holding portion 53 is provided with a structure for cooling by cooling water. More specifically, the seal holding portion 53 is provided with a cooling water path 54. This cooling water path 54 has an annular portion 54*a* surrounding the shaft 52, an inlet 54*b* adjoining the annular portion 54*a*, and an outlet 54*c* adjoining the annular portion 54*a*.

The cooling water path 54 is provided within a range from the tap water feed passage 41 to the cooling nozzle 51. That is, cooling water that has come up from the tap water feed passage 41 in a direction of arrow A1 flows through the inlet 54*b* into and through the annular portion 54*a*, and then flows through the outlet 54*c* along a direction of arrow A2, thus reaching the cooling nozzle 51.

Figure 6:
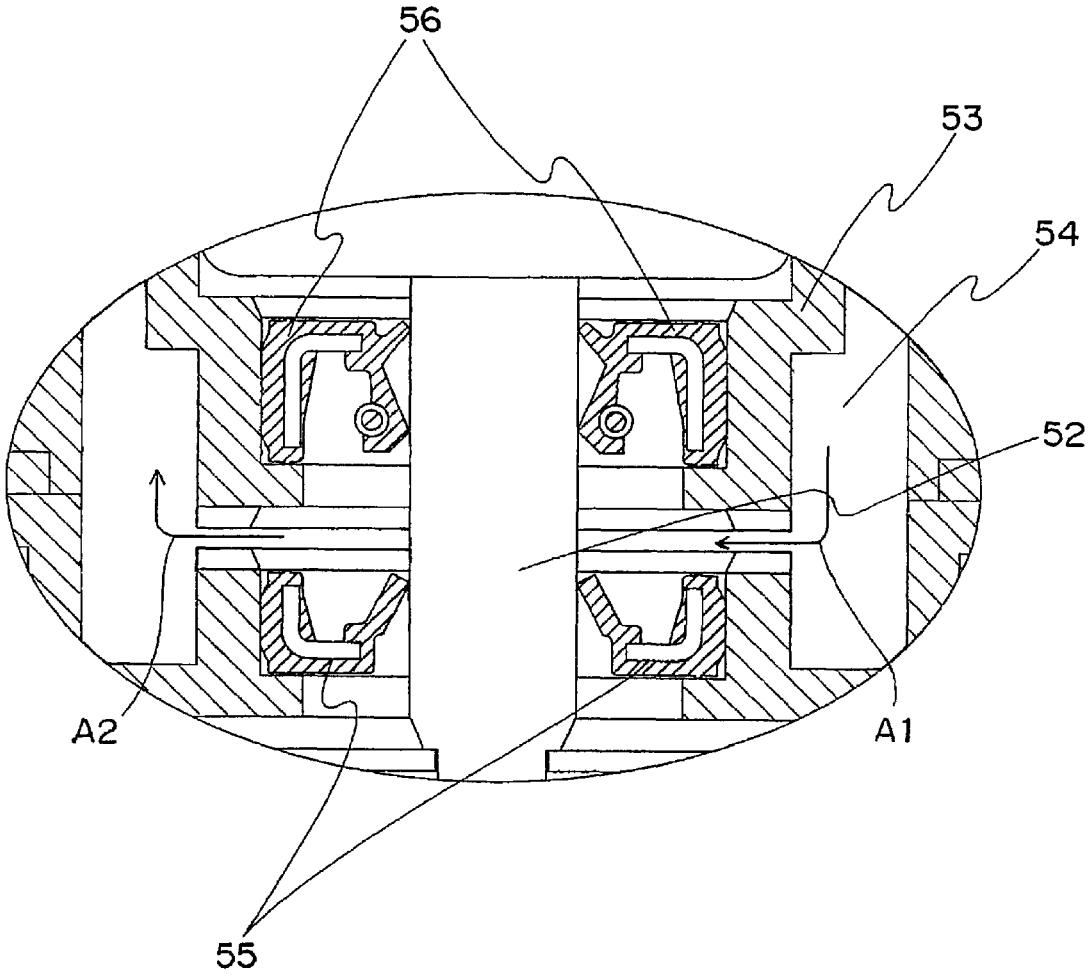
FIG. 6 is an enlarged view of an elliptical part of FIG. 5.

FIG. 6 shows an elliptical part E in FIG. 5 as it is enlarged.

Between the shaft 52 and the seal holding portion 53, first, second seal members 55, 56 are provided. Each of the first, second seal members 55, 56 has a core metal and a seal portion which is fitted to the core metal and which is made of NBR (acrylonitrile-butadiene rubber). The first seal member 55 makes one-point contact with the shaft 52, while the second seal member 56 makes two-point contact with the shaft 52. That is, between the shaft 52 and the seal holding portion 53 is a structure that provides three points of sealing. As a result of this, even if the washing liquid enters into the fan case 34, the fan motor 36 can be prevented from being wetted with the washing liquid. Also, the cooling water can be prevented from leaking out of the cooling water path 54.

According to the drum type washer-dryer having the construction described above, during drying process, air heated by the sheath heater 38 blows off through the air flow port 40 into the drum 4. As a result, the air impinges on the washing loads within the drum 4 so that the moisture of the washing loads is evaporated. The air containing moisture goes through the small holes 27 out of the drum 4, entering into the plate cover 48 and flowing along the plate 49 of the dehumidification heat exchanger 33. In this process, the air containing moisture is cooled by the cooling water flowing on the surface of the plate 49 as well as by the plate 49 cooled by the cooling water. Thus, the moisture of the air flowing along the plate 49 is effectively condensed. That is, the air is sufficiently dehumidified to a low humidity. This low-humidity air is sucked into the fan case 34, and then fed to the sheath heater 38 by the rotation of the blower fan 35, being heated by the sheath heater 38, and returns into the drum 4.

As shown above, by circulating air in the water tank 3 to and through the dehumidification heat exchanger 33, the blower 31 and the heating device 32 in sequence, the washing loads are dried. In this process, wastes such as waste threads of the washing loads enter into the fan case 34 so as to be deposited inside the fan case 34 or at one end portion of the shaft 52. However, since the inside of the fan case 34 or the one end portion of the shaft 52 is immersed in the washing liquid that flows into the fan case 34 during the next washing process or rinsing process, the wastes such as waste threads deposited inside the fan case 34 or at one end portion of the shaft 52 are caught by the flow of washing liquid, being removed. Accordingly, the occurrence that waste threads or other wastes are deposited at one end portion of the shaft 52 can be prevented. As a result of this, the path for the air contained in the fan case 34 is not narrowed and the rotational speed of the blower fan 35 is not lowered, so that the air for drying the washing loads can be continued to be efficiently circulated and moreover deterioration of the drying efficiency for washing loads can be prevented. That is, deterioration of the drying efficiency for washing loads can be prevented even over long-time use.

During the drying process, the shaft 52 rotates at, for example, 3000 rpm while keeping in contact with the first, second seal members 55, 56. Accordingly, the shaft 52 and the first, second seal members 55, 56 generate heat, tending to go high temperatures while the seal holding portion 53, to which the heat of the first, second seal members 55, 56 is transferred, tend to go high temperatures. However, since cooling water flows through the cooling water path 54 provided in the seal holding portion 53, this cooling water cools the shaft 52, the seal holding portion 53 and the first, second seal members 55, 56. Therefore, thermal damage of the shaft 52, the seal holding portion 53 and the first, second seal members 55, 56 can be reduced.

Also, since the cooling water path 54 is provided within the range from the tap water feed passage 41 to the cooling nozzle 51, the seal holding portion 53 can be cooled by the cooling water for cooling of the plate 49 during the drying process. Accordingly, the quantity of cooling water to be used in the drying process can be lessened. That is, a water saving effect can be obtained during the drying process.

Further, since the blower fan 35 rotates during the washing process or rinsing process, waste threads or other wastes deposited at one end portion of the shaft 52 can aggressively be removed.

Further, since the blower fan 35 rotates during the washing process or rinsing process, there occur water currents in the plate cover 48 and the heater case 37. Accordingly, waste threads or other wastes deposited on the plate 49 and the sheath heater 38 can be removed by the water currents caused by the rotation of the blower fan 35.

Further, while the washing process or rinsing process is carried out, the circulation pump 45 operates. Accordingly, the washing liquid in the water tank 3 goes through the drain port 10 out of the water tank 3, then flowing to and through the drain duct 21, the filtering device 22, the circulation pump 45 and the circulation hose 46 in sequence, thus blowing out from the circulation nozzle 47 toward inside of the drum 4. The washing liquid that has blown out to the drum 4 in this way goes through the small holes 27 out of the drum 4, and further goes through the drain port 10 out of the water tank 3. That is, during the washing of the washing loads in the drum 4 or during the rinsing of the washing loads, the washing liquid in the water tank 3 is circulated via the drain duct 21, the filtering device 22, the circulation pump 45 and the circulation hose 46. As a result, waste threads or other wastes contained in the washing liquid can be captured by the filtering device 22. Accordingly, the occurrence that waste threads or other wastes are deposited on the washing loads or at one end portion of the shaft 52 during the washing process or rinsing process can be prevented.

Further, since the drain port 10 is provided downstream of the blower 31, waste threads or other wastes that have dropped from the blower 31 can be discharged along with the washing liquid through the drain port 10 out of the water tank 3, and captured by the filtering device 22. Accordingly, the occurrence that waste threads or other wastes that have dropped from the blower 31 are circulated and re-deposited on the blower 31 can be prevented.

In this first embodiment, the blower 31 for sucking the air in the water tank 3 via the dehumidification heat exchanger 33 is attached to the water tank 3. However, a blower for sucking air present between the outer casing 1 and the water tank 3 via the dehumidification heat exchanger 33 may be attached to the water tank 3.

Otherwise, a blower for sucking air present outside the outer casing 1 via the dehumidification heat exchanger 33 may be attached to the water tank 3.

Otherwise, a blower for directly sucking air present between the outer casing 1 and the water tank 3 may be attached to the water tank 3. In this case, the dehumidification heat exchanger 33 does not need to be provided within the water tank 3. That is, the dehumidification heat exchanger 33 may be omitted from the drying system 6.

Otherwise, a blower for directly sucking air present outside the outer casing 1 may be attached to the water tank 3. In this case, the dehumidification heat exchanger 33 does not need to be provided within the water tank 3. That is, the dehumidification heat exchanger 33 may be omitted from the drying system 6.

In the first embodiment, the shaft 52 is cooled by the cooling water for cooling the plate 49. However, the shaft 52 may also be cooled by cooling water for exclusive use of cooling of the shaft 52. That is, there may be provided a cooling water feed passage for feeding the cooling water to the shaft 52 alone.

Second Embodiment

Figure 7:
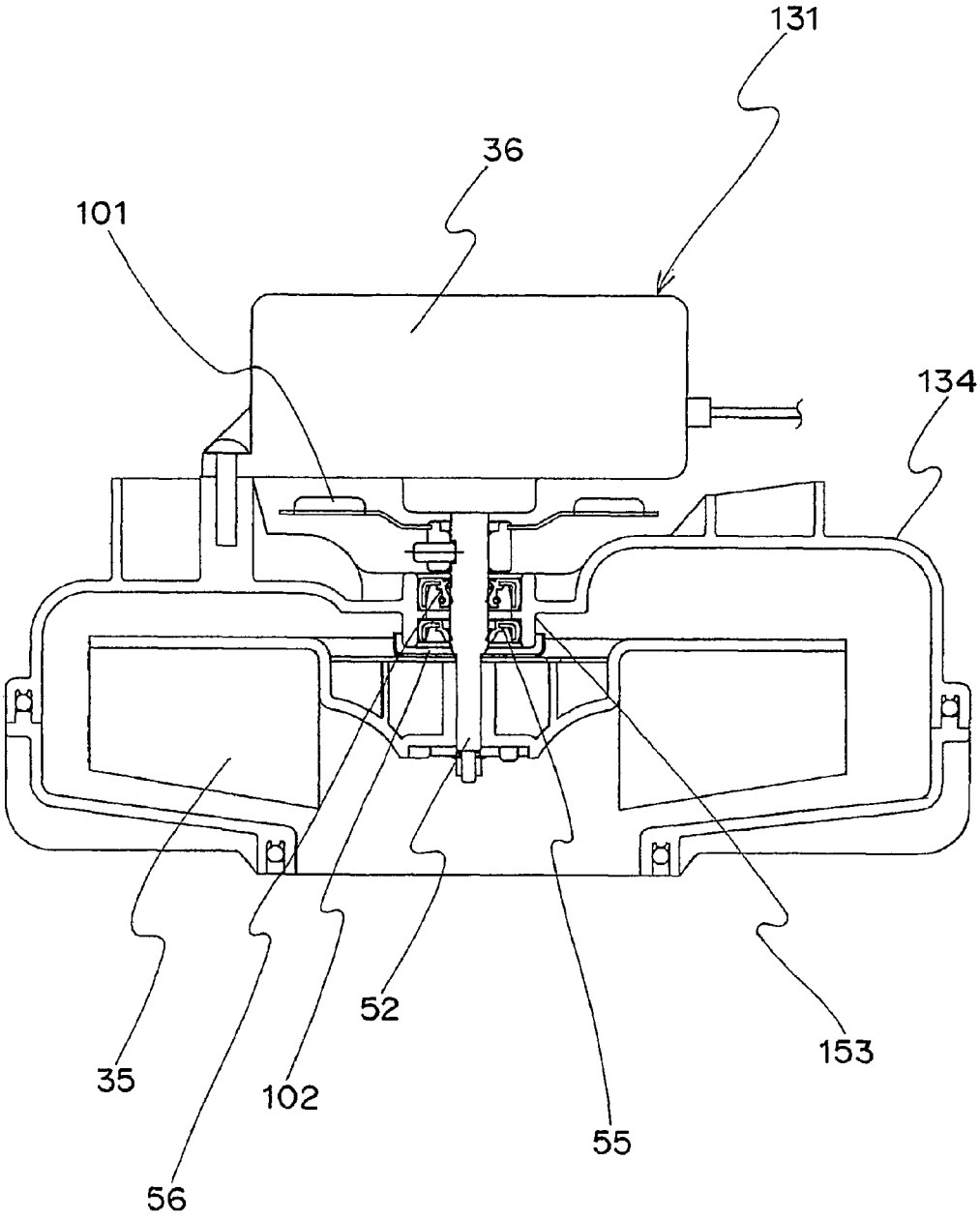
FIG. 7 is a schematic sectional view of a blower of a drum type washer-dryer according to a second embodiment of the invention.

FIG. 7 shows a schematic sectional view of a blower 131 of a drum type washer-dryer according to a second embodiment of the present invention. In FIG. 7, the same component parts as those of the blower 31 of the first embodiment shown in FIG. 5 are designated by the same reference numerals as those of FIG. 5 and their description is omitted.

The blower 131 has a fan case 134 and a aluminum cooling fan 101 for giving rise to a cooling air to cool the shaft 52.

The fan case 134 is provided with a seal holding portion 153. This seal holding portion 153 does not have a structure for cooling by cooling water like the cooling water path 54 of FIG. 5.

The cooling fan 101, which is fixed to the shaft 52 so as to be positioned between the fan motor 36 and the fan case 134, rotates integrally with the shaft 52.

Between the seal holding portion 153 and the blower fan 35 is placed a cap 102 for covering one end portion of the shaft 52 on the blower fan 35 side.

In the blower 131 having the construction shown above, as the shaft 52 rotates, the shaft 52 and the first, second seal members 55, 56 increase in temperature due to sliding friction against the first, second seal members 55, 56, whereas heat of the shaft 52 is radiated and cooled by the cooling fan 101. Accordingly, thermal damage of the first, second seal members 55, 56 can be reduced.

Also, the blower 131, for which the path for feeding cooling water to the seal holding portion 153 does not need to be provided around the fan case 134, is easy to install and has a high degree of freedom for the installation place.

Further, since the cap 102 covers one end portion of the shaft 52 on the blower fan 35 side, the occurrence that waste threads or other wastes are deposited at one end portion of the shaft 52 on the blower fan 35 side can be prevented.

Third Embodiment

Figure 8:
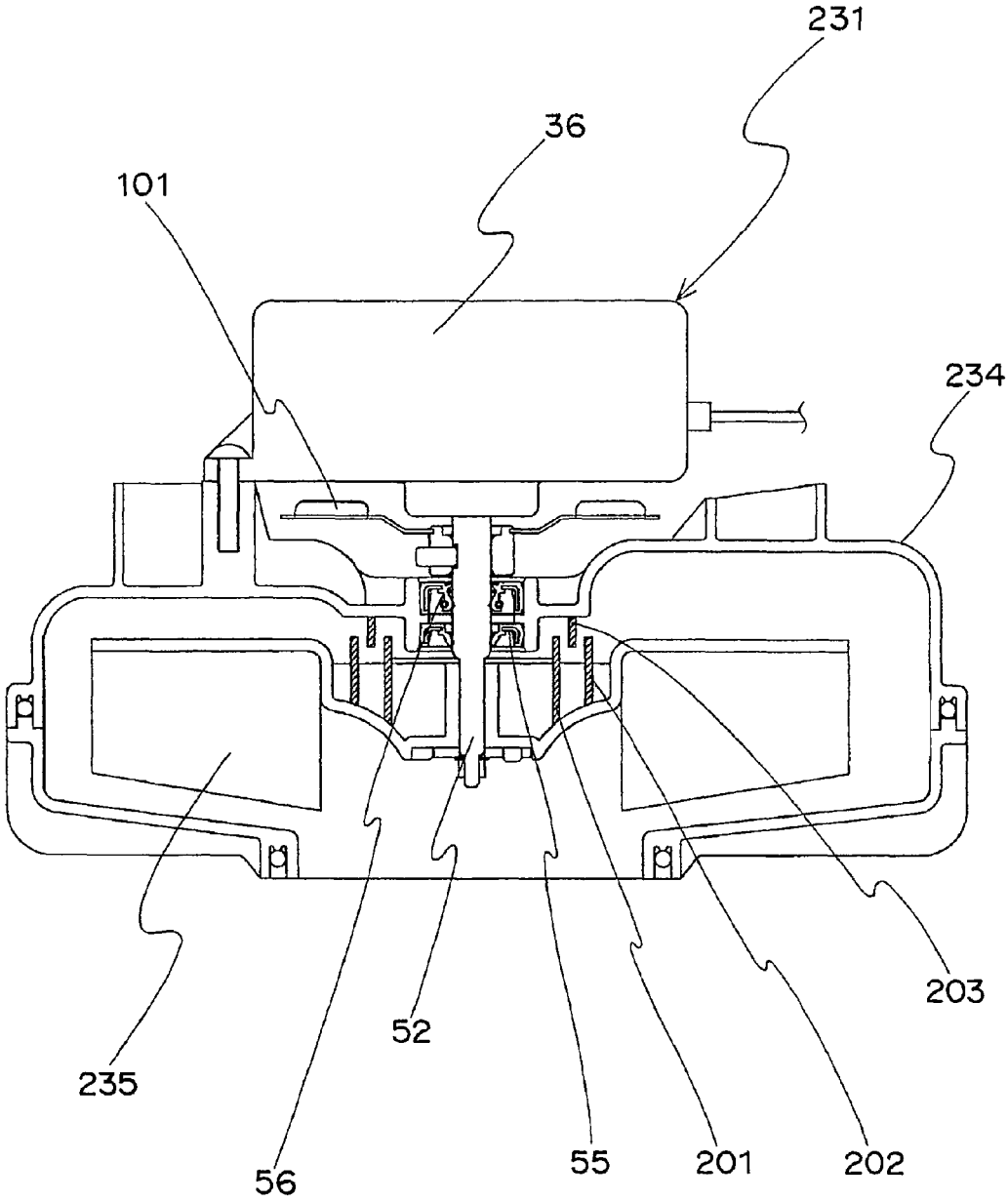
FIG. 8 is a schematic sectional view of a blower of a drum type washer-dryer according to a third embodiment of the invention.

FIG. 8 shows a schematic sectional view of a blower 231 of a drum type washer-dryer according to a third embodiment of the invention. In FIG. 8, the same component parts as those of the blower 131 of the second embodiment shown in FIG. 7 are designated by the same reference numerals as those of FIG. 7 and their description is omitted.

The blower 231 differs from the blower 131 of the second embodiment in a fan case 234 and a blower fan 235.

On a fan motor 36 side surface of a hub portion that is a part of the blower fan 235 are provided a cylindrical-shaped first rib 201 and a cylindrical-shaped second rib 202 having a diameter larger than that of the first rib 201. The first rib 201 is generally concentric with the second rib 202.

With regard to the fan case 234, a cylindrical-shaped third rib 203 is provided on one surface of a portion opposed to the hub portion on the blower fan 235 side. The third rib 203 has a diameter larger than that of the first rib 201 and smaller than that of the second rib 202. Then, the third rib 203 is opposed to a space between the first rib 201 and the second rib 202. More specifically, a tip portion of the third rib 203 is intruding inside a space between the first rib 201 and the second rib 202.

In the blower 231 having the above construction, as the shaft 52 rotates, the shaft 52 and the first, second seal members 55, 56 increase in temperature due to sliding friction against the first, second seal members 55, 56, whereas heat of the shaft 52 is radiated and cooled by the cooling fan 101. Accordingly, thermal damage of the first, second seal members 55, 56 can be reduced.

Also, the blower 231, for which the path for feeding cooling water to the seal holding portion 153 does not need to be provided around the fan case 134, is easy to install and has a high degree of freedom for the installation place.

Further, since the first, second, third ribs 201, 202, 203 are provided, the occurrence that waste threads or other wastes are deposited at one end portion of the shaft 52 on the blower fan 235 side can be prevented.

In the third embodiment, three cylindrical-shaped ribs having different diameters are provided for the prevention of deposition of waste threads or other wastes at the blower fan 235 side end portion of the shaft 52. However, four or more cylindrical-shaped ribs having different diameters may also be provided.

The present invention can be applied not only to drum type washer-dryers but also to vertical type washer-dryers.

Also, needless to say, contents of the above description may be combined together in various ways as required to constitute the present invention.

Embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A washer-dryer comprising:

an outer casing;

a water tank placed within the outer casing;

a rotary tank which is rotatably placed within the water tank and which contains therein washing loads;

a fan unit for blowing air into the water tank during drying process; and a heating unit which is provided downstream of the fan unit and which heats air directed toward interior of the water tank, wherein the fan unit has:

a blower fan;

a fan motor for driving the blower fan into rotation; and a shaft having one end portion coupled to the blower fan and the other end portion coupled to the fan motor, and wherein the one end portion of the shaft is immersed in washing liquid fed into the water tank during washing process or rinsing process; and wherein the fan unit comprises:

a seal member provided in adjacency to the shaft to maintain the blower fan and the fan motor watertight therebetween; and an aluminum cooling fan fixed integrally to the shaft so as to be positioned between the fan motor and a fan case and so as to function as a rotational radiation plate to draw heat away from the shaft for reducing thermal damage to the seal member.

2. The washer-dryer as claimed in claim 1, further comprising a dehumidification unit which is provided upstream of the heating unit and which dehumidifies the air directed toward the interior of the water tank, wherein the fan unit sucks the air in the water tank during drying process and blows the sucked air into the water tank.

3. The washer-dryer as claimed in claim 2, wherein the blower fan is driven into rotation during washing process or rinsing process.

4. The washer-dryer as claimed in claim 1, wherein the heating unit is immersed in washing liquid fed into the water tank during washing process or rinsing process.

5. The washer-dryer as claimed in claim 2, wherein the dehumidification unit is immersed in washing liquid fed into the water tank during washing process or rinsing process.

6. The washer-dryer as claimed in claim 1, further comprising:

a circulation path for returning into the water tank the washing liquid, which has come out of the water tank from within the water tank, to thereby circulate the washing liquid;

a filtering device which is placed on the circulation path and which removes wastes from the washing liquid flowing in the circulation path; and a circulation pump for sucking the washing liquid present in the water tank out of the water tank and discharging the sucked washing liquid toward the interior of the water tank, wherein the circulation pump is operated during washing process or rinsing process.

7. The washer-dryer as claimed in claim 6, wherein the circulation path has a suction port provided downstream of the fan unit for sucking therethrough the washing liquid present in the water tank.

8. The washer-dryer as claimed in claim 1, wherein the shaft is cooled by cooling water or cooling air.

9. The washer-dryer as claimed in claim 2, wherein the shaft is cooled by cooling water and the cooling water that has cooled the shaft is fed to the dehumidification unit.

* * * * *